US006988916B2

(12) United States Patent
Taguchi

(10) Patent No.: US 6,988,916 B2
(45) Date of Patent: Jan. 24, 2006

(54) CONNECTOR AND METHOD FOR PRODUCING THEREOF

(75) Inventor: Hiroyuki Taguchi, Kanagawa (JP)

(73) Assignee: J.S.T. Mfg., Co., Ltd., Osaka (JP)

( * ) Notice: Subject to any disclaimer, the term of this patent is extended or adjusted under 35 U.S.C. 154(b) by 0 days.

(21) Appl. No.: 10/689,700

(22) Filed: Oct. 22, 2003

(65) Prior Publication Data

US 2004/0136323 A1 Jul. 15, 2004

(30) Foreign Application Priority Data

Oct. 23, 2002 (JP) ..... 2002-308941

(51) Int. Cl.
*H01R 4/48* (2006.01)

(52) U.S. Cl. ..... 439/862

(58) Field of Classification Search ..... 439/862, 439/630, 326, 342, 633, 76.1, 912, 736
See application file for complete search history.

(56) References Cited

U.S. PATENT DOCUMENTS

| | | | | |
|---|---|---|---|---|
| 3,568,136 A * | 3/1971 | Wells | 439/638 |
| 6,544,074 B2 * | 4/2003 | Bricaud et al. | 439/630 |
| D499,380 S * | 12/2004 | Washino et al. | D13/147 |
| D503,680 S * | 4/2005 | Taguchi | 66/174 |

FOREIGN PATENT DOCUMENTS

| | | |
|---|---|---|
| EP | 0693802 A2 | 1/1996 |
| EP | 0693802 A3 | 3/1996 |
| EP | 0926780 A2 | 6/1999 |
| EP | 0926780 A3 | 10/2000 |
| EP | 1074936 A1 | 2/2001 |
| JP | 6-36834 A1 | 2/1994 |
| JP | 6-79990 A1 | 3/1994 |
| JP | 6-196214 A1 | 7/1994 |
| JP | 7-37655 A1 | 2/1995 |
| JP | 7-326441 A1 | 12/1995 |
| JP | 7-335343 A1 | 12/1995 |
| JP | 8-96871 A1 | 4/1996 |
| JP | 9-504409 A1 | 4/1997 |
| JP | 10-22008 A1 | 1/1998 |
| JP | 11-195467 A1 | 7/1999 |

* cited by examiner

*Primary Examiner*—P. Austin Bradley
*Assistant Examiner*—Phuongchi Nguyen
(74) *Attorney, Agent, or Firm*—Rader, Fishman & Grauer PLLC

(57) ABSTRACT

The present invention relates to a connector for electrically connecting a card and a lead wire. The connector includes a housing to and from which the card can be inserted and pulled out along a surface of the housing and a contact built in the housing, the contact having a pair of exposed ends, one of the exposed ends capable of connecting to the lead wire, the other of the exposed ends capable of connecting to the card when the card is inserted. The housing has a first communication hole communicating with the contact, and the first communication hole has a diameter which allows a probe for a connector conduction test to be inserted into the first communication hole. According to the present invention, the first communication hole defined by the support pin for supporting the contacts are utilized as the insertion holes of the probe for the connector conduction test, so that production efficiency of the connector can be improved.

3 Claims, 3 Drawing Sheets

CONNECTOR AND METHOD FOR PRODUCING THEREOF

BACKGROUND OF THE INVENTION

1. Technical Field

The present invention relates to a connector for electrically connecting a card, which can be inserted and pulled out, to a lead wire. More particularly, the present invention relates to a connector for a memory card, for example.

2. Background Art

Conventionally, a connector for electrically connecting a card, which can be inserted and pulled out, to lead wires is known. To electrically connect the card to the lead wires, the connector includes a housing, to and from which the card can be fitted and pulled out along a surface of the housing and a plurality of contacts built in the housing and having both ends thereof exposed. One of the exposed ends of each contact (hereinafter called "lead wire connection portion") can be connected to the lead wire. The other of the exposed ends of each connector (hereinafter called "card connection portion") can be connected to the card under a loaded state.

Large connectors are produced by a method having the steps of forming the contacts, separately forming the housing, and fitting the contacts into the housing. On the other hand, small connectors are formed by a method having the steps of fixing the contacts in a mold and injecting a resin under this state into the mold so as to integrally mold the contacts and the housing (refer to JP-A-11-195467, for example).

In the integral molding method described above, support pins for supporting the contacts are so arranged as to protrude into the mold for preventing a positioning error of the contacts due to fluidization of the resin inside the mold. Therefore, even when the molten resin is injected into the mold, the resin does not fill the spaces occupied by the support pins, and traces of the support pins are formed as holes in the housing.

On the other hand, the connectors completed are subjected to various tests such as an inspection with eye, a withstand voltage test, a conduction test, and so forth, to secure product quality. More concretely, the inspection with eye checks whether any deformation exists at the lead wire connection portion of the contact and its card connection portion, whether any distortion exists in the housing and whether the adjacent contacts do not keep contact with each other. The conduction test checks whether electric conduction is secured between a connected part of each contact to the lead wire and its connected part to the card. More specifically, the conduction test is carried out while a probe for a connector conductor test is brought into contact with the lead wire connection portion of the contact and its card connection portion. However, it is sometimes difficult according to this method to stably conduct the conduction test.

To solve this problem, it might be possible to employ a method that inserts the probe into the hole formed at the trace of each support pin formed in the housing. According to this method, however, the probe cannot be inserted because the hole of the support pin is small.

It might also be possible to separately form a communication hole for the probe in the housing. According to this method, however, production steps become more complicated and production efficiency of the connector may drop.

DISCLOSURE OF THE INVENTION

In view of the problems described above, it is an object of the present invention to provide a connector that allows a conduction test to be reliably carried out without inviting the drop of production efficiency and to provide a method for producing such a connector.

More concretely, the present invention provides the following.

(1) A connector for electrically connecting a card and a lead wire, comprising: a housing for to and from which the card can be inserted and pulled out along a surface of said housing; and a contact built in said housing, said contact having a pair of exposed ends, one of the exposed ends capable of connecting to a lead wire, the other of the exposed ends capable of connecting to the card when the card is inserted, wherein said housing has a first communication hole communicating with the contact, said first communication hole having a diameter which allows a probe for a connector conduction test to be inserted into said first communication hole.

Here, the contact is formed of an electrically conductive material such as a metal. The shape of the contact is not particularly limited, and may be a flat sheet shape, a cylindrical shape, a bent shape, a folded shape, and so forth. The contact and the lead wire are connected to each other through soldering, for example.

The position of the first communication hole is not particularly limited.

The housing is formed of a non-conductive material inclusive of an insulating material, as typified by a resin such as polypropylene and polycarbonate, and preferably a liquid crystal polymer.

The housing holds the contact at a predetermined position relative to the card inserted. Preferably, the contact does not fall off from the housing even when the contact expands by thermal expansion due to a temperature change.

The connector conduction test includes a test for confirming conduction of the connector and a test for measuring a resistance value of the connector. The probe is an electrode which is used for the connector conduction test and is brought into contact with a measurement position. The probe is a thinly elongated member having a predetermined length and a predetermined sectional shape, for example, but the sectional shape is not particularly limited. The sectional shape of the probe includes a circle, an ellipse, a rectangle and a polygon but the round shape is preferred. The forward end shape of the probe includes a spherical shape and a planar shape but is preferably spherical.

The first communication hole has a diameter such that the probe can be inserted into the first communication hole to contact the contact. When a pitch of the contacts of the connector is 2.5 mm and the hole diameter of the first communication hole is 1.5 mm, for example, an outer diameter of the probe is preferably 1.5 mm or below.

In the present invention, the connector conduction test can be conducted by merely inserting the probe for the connector conduction test into the first communication hole.

The connector can be produced in the followings. First, a contact is supported through support pins inside a mold. Next, a resin is injected into the mold so as to mold a housing. Subsequently, the mold and the support pin are released from the housing so as to form a first communication hole inside the housing. The first communication hole communicates with the contact and has a diameter which allows a probe for a connector conduction test to be inserted into the first communication hole. In consequence, because the first communication hole defined by the support pin for supporting the contacts are utilized as the insertion holes of the probe for the connector conduction test, production efficiency of the connector can be improved.

(2) In the connector described in (1), the present invention provides a connector, wherein the diameter of said first communication hole is smaller than a width of said contact.

When the shape of the contact is not a thinly elongated shape, the term "width of said contact" means the size in a direction perpendicular to the insertion direction. When the contact has the thinly elongated shape, for example, the term may be so understood as to mean the size in a minor direction.

(3) The present invention provides a method of producing a connector for electrically connecting a card and a lead wire, including a housing to and from which the card can be inserted and pulled out along a surface of the housing and a contact built in the housing, the contact having a pair of exposed ends, one of the exposed ends capable of connecting to the lead wire, the other of the exposed ends capable of connecting to the card when the card is inserted, said method comprising: a contact holding step of supporting the contact with first support pin so as to hold the contact inside a mold; a molding step of injecting a resin into said mold so as to form the housing; and a mold releasing step of releasing said mold and said first support pin from the housing to form a first communication hole communicating with the contact inside the housing, said communication hole having a diameter which allows a probe for a connector conductor test to be inserted into said first communication hole.

Here, the portion of the contact which is supported by the first support pin is not particularly limited. The contacts may be connected each other through a material of the contact (such as a metal). This construction makes it possible to effectively prevent displacement of the contact due to fluidization of a resin even when the resin is injected into the mold.

In the present invention, the hole formed by the first support pin for supporting the contacts is used as the hole for inserting a probe for a connector conduction test in the process for producing the connector, and production efficiency of the connector can be therefore improved.

The conduction test of the connector can be carried out when the probe for the connector conduction test is merely inserted into the first communication hole.

(4) In the method for producing a connector described in (1), the present invention provides a method of producing a connector wherein the diameter of said first support pin is a size not less than a sum of an outer diameter of said probe for a connector conduction test and a positioning error in said contact holding step.

Here, the positioning error of the probe is about 50% of the outer diameter of the probe, for example. When the connector is relatively large, however, the positioning error of the probe may be smaller than 50%, and may be 20% or below of the outer diameter.

(5) In the method for producing a connector of the connector described in (3), the present invention provides a method of producing a connector wherein said contact holding step further comprises supporting said contact with a second support pin together with said first support pin.

In the present invention, since the first support pin and the second support pin support at two portions of the contact, so that the positioning error of the contact due to fluidization of the resin can be effectively prevented even when the resin is injected into the mold.

(6) In the method for producing a connector of the connector described in (5), the present invention provides a method of producing a connector wherein said mold releasing step further comprises releasing said mold and said second support pin from the housing to form in the housing a second communication hole communicating with the contact, said second communication hole having a diameter which allows said probe for the connector conduction test to be inserted into said second communication hole.

(7) In the method for producing a connector of the connector described in any one of (3) to (6), the present invention provides a method of producing a connector wherein said first support pin supports substantially a center of said contact in said contact holding step.

In the present invention, the positioning error of the contact can be prevented due to fluidization of the resin even when the resin is injected into the mold, so that the contact can be effectively held.

(8) In the method for producing a connector of the connector described in any one of (3) to (6), the present invention provides a method of producing a connector wherein said contact holding step further comprises clamping said contact with said mold.

In the present invention, the contact is supported by the first support pin and the mold, so that the positioning error of the contact due to fluidization of the resin can be present even when the resin is injected into the mold.

(9) The present invention further provides a method for producing a connector for electrically connecting a card and a lead wire, including a housing to and from which said card can be inserted and pulled out along a surface of the housing and a contact built in the housing, the contact having exposed ends, one of the exposed ends capable of connecting to the lead wire and the other of the exposed ends capable of connecting to the card when the card is inserted, said method comprising: a contact holding step of supporting the contact with a support pin so as to hold the contact inside a mold; a molding step of injecting a resin into said mold so as to mold the housing; a mold releasing step of releasing said mold and said support pin from the housing to form a communication hole communicating with the contact inside the housing; and a communication hole expansion step of expanding a diameter of said communication hole to allow a probe for a connector conduction test to be inserted into said communication hole.

The present invention can acquire advantages similar to those of (3).

(10) The present invention further provides a method for improving production efficiency of a connector for electrically connecting a card and a lead wire, including a housing to and from which the card can be inserted and pulled out along a surface of the housing and a contact built in the housing, the contact having a pair of exposed ends, one of the exposed ends capable of connecting to said lead wire, the other capable of connecting to the card when the card is inserted, said method comprising: a contact holding step of supporting the contact with support pin so as to hold the contact inside a mold;

a molding step of injecting a resin into said mold so as to form the housing; and a mold releasing step of releasing said mold and said support pin from the housing to form a communication hole communicating with the contact inside the housing, said communication hole having a diameter which allows a probe for a connector conduction test to be inserted into said communication hole.

The present invention can acquire advantages similar to those of (3).

(11) The present invention further provides a method for testing conduction of a connector for electrically connecting a card and a lead wire, including a housing to and from which the card can be inserted and pulled out along a surface of the housing and a contact built in the housing, the contact having a pair of exposed ends, one of the exposed ends capable of connecting to the lead wire, the other of the exposed ends capable of connecting to the card when the card is inserted, said method comprising the steps of: forming a communication hole communicating with the contact inside the housing, said communication hole having a diameter which allows a probe for a connector conduction test to be inserted into said communication hole; and inserting said probe for a connector conduction test into said communication hole.

The present invention can acquire advantages similar to those of (3).

PREFERRED EMBODIMENTS OF THE INVENTION

Figure 1:
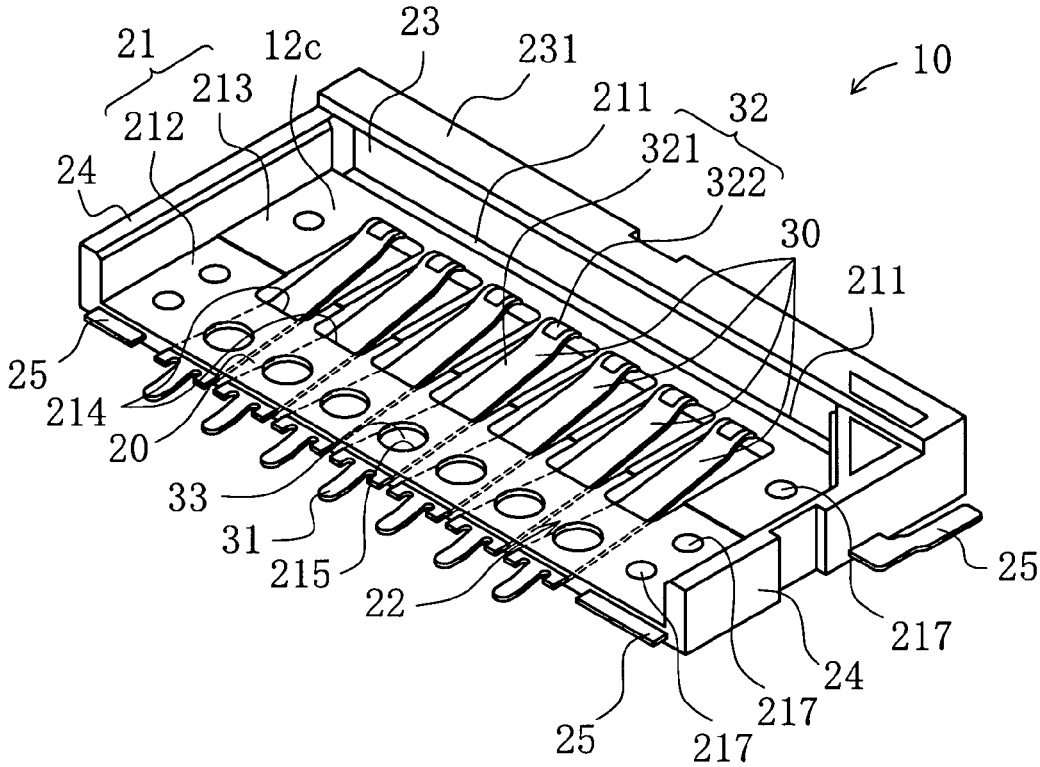
FIG. 1 is a general perspective view of a connector according to an embodiment of the present invention.
Figure 2:
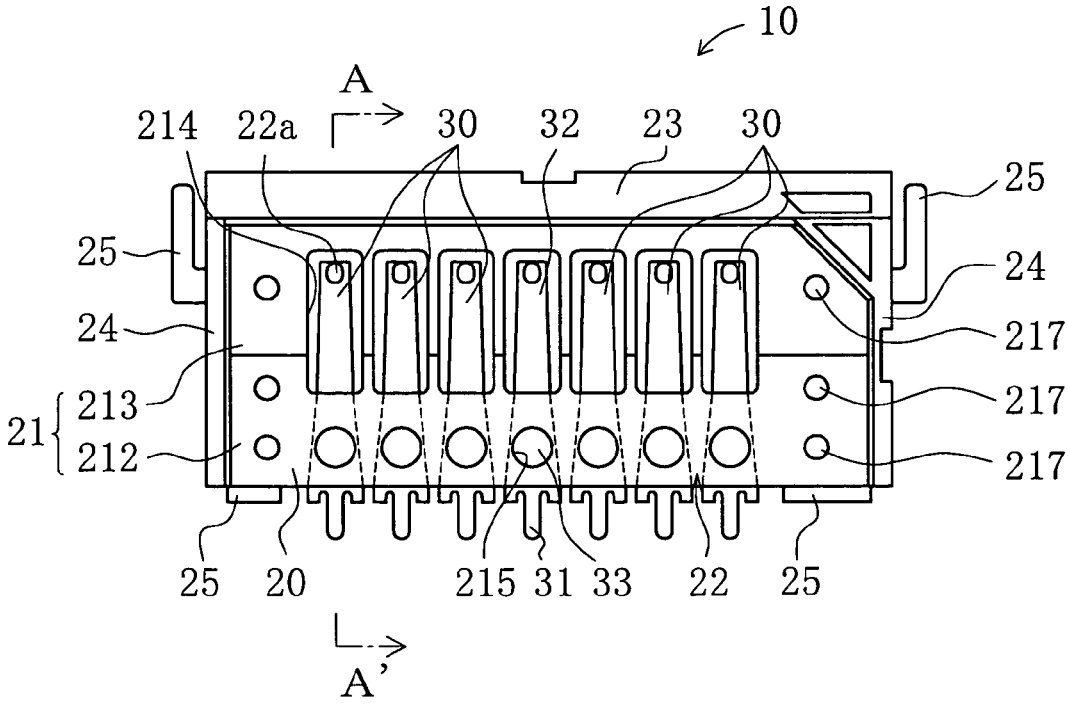
FIG. 2 is a plan view of the connector according to the embodiment described above.
Figure 3:
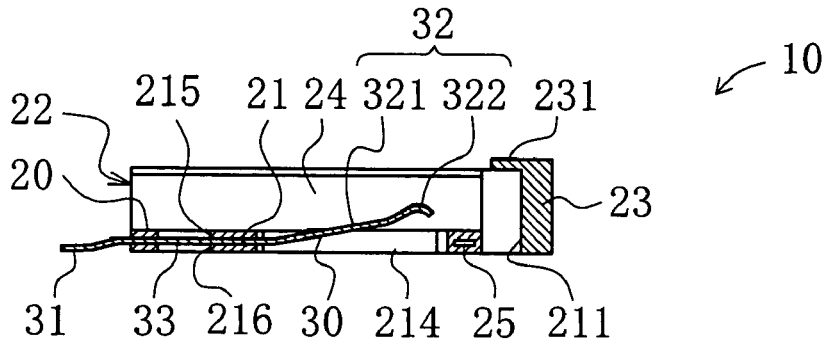
FIG. 3 is a sectional view through A–A' in FIG. 2.

An embodiment of the present invention will be described hereinafter with reference to the accompanying drawings. FIG. 1 is a general perspective view of a connector 10 according to an embodiment of the present invention. FIG. 2 is a plan view of the connector 10. FIG. 3 is a sectional view through A–A' in FIG. 2.

The connector 10 is for electrically connecting a card and lead wires. This connector 10 includes a housing 20 that allows the card to be inserted into and pulled out along the surface thereof and a plurality of contacts 30 which is built in the housing 20 and to which the lead wires are connected.

The housing 20 is made of a resin and includes a flat and rectangular housing base portion 21 which has a insertion opening 22 into which the card is inserted, a wall portion 23 arranged on the opposite side of the housing base portion 21 from the insertion opening 22, and two wall portions 24 formed in the housing base portion 21 to interpose the insertion opening 22 and the wall portions 23 between them.

The housing base portion 21 includes a thin portion 212 formed on the side of the insertion opening 22 and an thick portion 213 having a greater thickness than the thin portion 212 and formed on the side of the wall portion 23.

A recess portion 211 is formed in the thick portion 213 of the housing base portion 21 and extends along the wall portion 23. The wall portion 23 has a ceiling portion 231 which horizontally extends so as to cover the recess portion 211. Aforward end of a memory card is engaged to the recess portion 211.

Seven openings 214 which are substantially rectangular are formed in the housing base portion 21 so as to extend between the thin portion 212 and the thick portion 213. More concretely, each of the opening 214 extends from the side of the insertion opening 22 to the side of the wall portion 23.

The contacts are made of a metal and the number of the contacts 30 is seven. Each of the contact 30 has an embedded portion 33 which is embedded in the housing 20, a lead wire connection portion 31 which is formed at one end of the embedded portion 33 and can be connected to the lead wire, and a card connection portion 32 which is formed at the other end of the embedded portion 32 and can be connected to the card when the card is inserted. In other words, both ends of the contact 30 are exposed from the housing 20.

The card connection portion 32 is disposed in each of the opening 214 of the housing 20. The card connection portion 32 has a spring 321 supported in a cantilever fashion at the edge of the opening 214 and a protuberance 322 provided on a forward end of the spring 321. The spring 321 is inclined toward the card side as it extends forward, so that it can come into contact with the card at an appropriate contact pressure.

The communication holes 215, 216 are formed in the housing 20. Each of the communication hole 215, 216 communicates with the embedded portion 33 of the contact 30 and has a diameter which allows a probe for a connector conduction test to be inserted into them. The communication hole 215 communicates the surface of the housing 20 to the embedded portion 33. On the other hand, the communication hole 216 communicates the back of the housing 20 to the embedded portion 33. These communication holes 215, 216 are formed to oppose each other and interpose the embedded portion 33 between them. The communication holes 215, 216 have a round shape and their diameter is about 1.5 mm.

The frame members 25 made of a metal are embedded in the housing 20. The frame members 25 are disposed to encompass the contacts 30. The frame members 25 are exposed outside from both sides of the lead wire connection portions 31 and outside of the wall portion 24.

The communication holes 217, 218 are formed in the housing 20. The communication holes 217, 218 communicate with the embedded portions of the frame members 25 and have a diameter which does not allow the probe for the connector conductor test to be inserted into them. The communication hole 217 communicates the surface of the housing 20 to the frame member 25. On the other hand, the communication hole 218 communicates the back of the housing 20 to the frame member 25. These communication holes 217, 218 are formed to oppose each other and interpose the frame member 25 between them.

By soldering the exposed portion of the frame member 25 to a substrate not shown in the drawings, the connector can be easily attached to the substrate. The frame members 25 can prevent deformation of the connector 10 due to the residual stress during molding of the connector 10 and the external stress.

Figure 4:
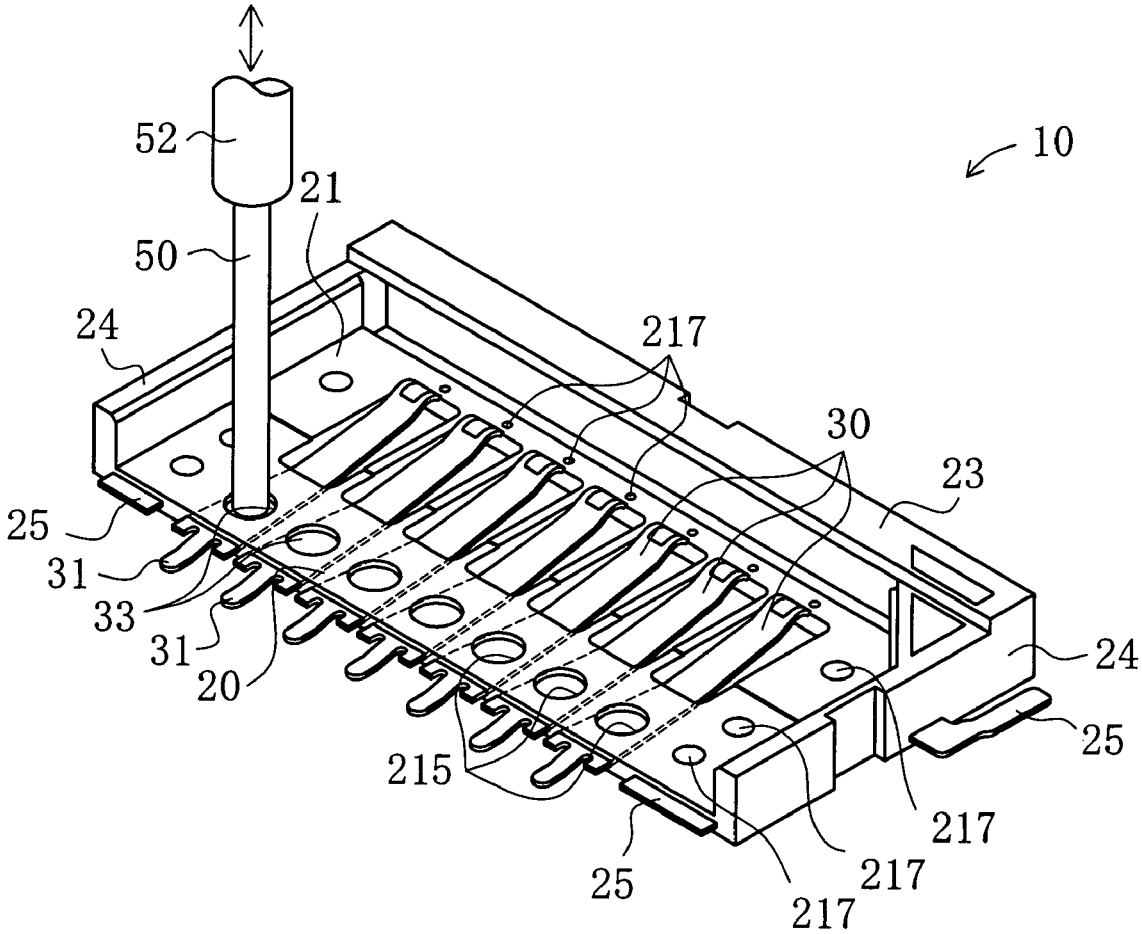
FIG. 4 is a perspective view for explaining a conduction test of the connector according to the embodiment described above.

Next, procedure of a conduction test of the connector 10 will be described with reference to FIG. 4.

A conduction tester includes a main body not shown, a first probe 50, and a second probe not shown.

First, the forward end of the probe 50 is inserted into the communication hole 215 by gripping a probe holding portion 52 of the probe 50, so that the probe 50 comes into contact with the embedded portion 33 of the contact 30.

Next, the forward end of the second probe is come into contact with the lead wire connection portion 31 of the contact 30. In this way, the conduction state of the connector 10 is tested through the conduction tester.

A process for producing the connector will be described with reference to FIG. 5.

Figure 5:
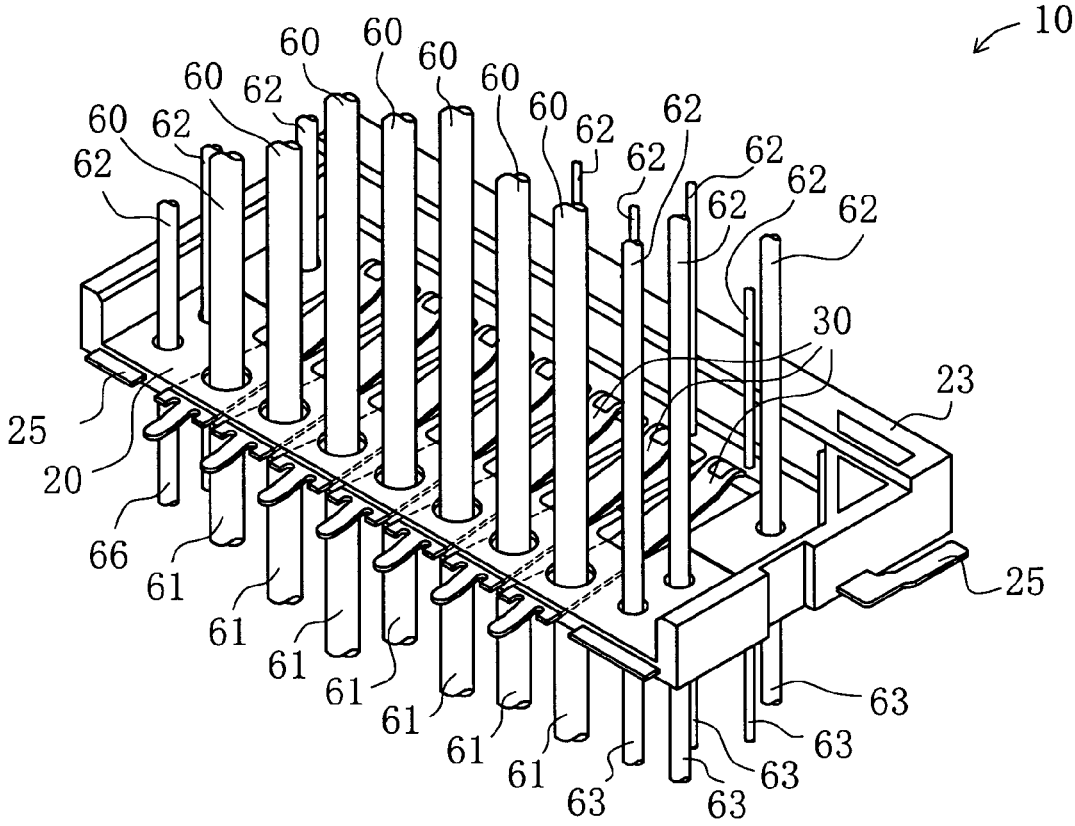
FIG. 5 is a perspective view for explaining process for producing the connector according to the embodiment described above.

A mold is omitted from FIG. 5 in order to understand the description more easily.

To begin with, a plurality of contacts 30 is clamped and supported by contact support pins 60, 61 as the first support pins. At the same time, the frame member 25 is clamped and supported by frame member support pins 62, 63.

A resin is then injected into the mold to mold the housing 20.

Finally, the mold, the contact support pins 60, 61, and the frame support pins 62, 63 are released from the mold.

Incidentally, the present invention is not limited to the embodiment described above but embraces those modifications and improvements within the scope capable of accomplishing the object of the present invention.

The connector and the method for producing a connector according to the present invention provide the following advantages.

The connector conduction test can be conducted by merely inserting the probe for the connector conduction test into the first communication hole. Because the first communication hole defined by the support pin for supporting the contacts are utilized as the insertion holes of the probe for the connector conduction test, production efficiency of the connector can be improved.

What is claimed is:

1. A connector for electrically connecting a card and a lead wire, comprising:

a housing for to and from which the card can be inserted and pulled out along a surface of said housing; and a contact built in said housing, said contact having a pair of exposed ends and an embedded portion positioned between said exposed ends and embedded in said housing, one of the exposed ends capable of connecting to a lead wire, the other of the exposed ends capable of connecting to the card when the card is inserted, wherein said housing comprises:

a substantially flat and rectangular housing base portion holding said contact by embedding said embedded portion, a first communication hole formed on one surface of said housing base portion to communicate with said embedded portion of the contact, said first communication hole having a diameter which allows a probe for a connector conduction test to be inserted into said first communication hole; and a second communication hole formed on the other surface of said housing base portion to communicate with said embedded portion of the contact, said second communication hole being formed opposite to said first communication hole.

2. The connector according to claim 1, wherein the diameter of said first communication hole is smaller than a width of said contact.

3. A method for testing conduction of a connector for electrically connecting a card and a lead wire, including a housing to and from which the card can be inserted and pulled out along a surface of the housing and a contact built in the housing, the housing comprising a substantially flat and rectangular housing base portion holding the contact, the contact having a pair of exposed ends and an embedded portion positioned between said exposed ends and embedded in said housing, one of the exposed ends capable of connecting to the lead wire, the other of the exposed ends capable of connecting to the card when the card is inserted, said method comprising the steps of:

forming a first communication hole on one surface of said housing base portion to communicate with said embedded portion of the contact inside the housing, said first communication hole having a diameter which allows a probe for a connector conduction test to be inserted into said first communication hole;

forming a second communication hole in the other surface of said housing base portion to communicate with said embedded portion of the contact, said second communication hole being formed opposite to said first communication hole; and inserting said probe for a connector conduction test into said first communication hole such that said probe can make an electrical contact with a portion of the contact, the portion of the contact being exposed out of the first communication hole.

* * * * *